US011079181B2

(12) United States Patent
Disori et al.

(10) Patent No.: US 11,079,181 B2
(45) Date of Patent: Aug. 3, 2021

(54) CAST PLATE HEAT EXCHANGER WITH TAPERED WALLS

(71) Applicant: United Technologies Corporation, Farmington, CT (US)

(72) Inventors: Michael A. Disori, Glastonbury, CT (US); Alexander Broulidakis, Tolland, CT (US); William P. Stillman, Sturbridge, MA (US); David Donald Chapdelaine, Ellington, CT (US); Peter E. Gunderson, West Hartford, CT (US); Dave J. Hyland, Portland, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 64 days.

(21) Appl. No.: 16/292,692

(22) Filed: Mar. 5, 2019

(65) Prior Publication Data

US 2019/0339012 A1 Nov. 7, 2019

Related U.S. Application Data

(60) Provisional application No. 62/666,184, filed on May 3, 2018.

(51) Int. Cl.
*F28D 1/053* (2006.01)
*F28F 1/10* (2006.01)
(Continued)

(52) U.S. Cl.
CPC ..... *F28D 1/05383* (2013.01); *F28F 1/025* (2013.01); *F28F 1/10* (2013.01); *F28F 9/02* (2013.01); *F28F 2009/0292* (2013.01)

(58) Field of Classification Search
CPC combination set(s) only.
See application file for complete search history.

(56) References Cited

U.S. PATENT DOCUMENTS 3,016,230 A * 1/1962 Cederstrom ..... F28F 1/025 165/148
4,682,650 A * 7/1987 Potier ..... F28D 1/05316 165/173

(Continued)

FOREIGN PATENT DOCUMENTS

EP 3499170 A1 6/2019
FR 2929391 A1 * 10/2009 ..... F28F 9/16

(Continued)

OTHER PUBLICATIONS

European Search Report for EP Application No. 19172145.5 dated Sep. 26, 2019.

*Primary Examiner* — Devon Russell
(74) *Attorney, Agent, or Firm* — Carlson, Gaskey & Olds, P.C.

(57) ABSTRACT

In a featured embodiment, a heat exchanger includes a plate including a plate portion having outer walls. A plurality of internal passages extend between end portions. A ratio between an outer wall cross-sectional thickness at one of the end portions and a cross-sectional wall thickness of the outer wall within the plate portion is greater than 2.5 and no more than 10. An inlet manifold is attached to the inlet end. An outlet manifold is attached to the outlet end.

17 Claims, 4 Drawing Sheets

(51) Int. Cl.
*F28F 9/02* (2006.01)
*F28F 1/02* (2006.01)

(56) References Cited

U.S. PATENT DOCUMENTS 5,579,832 A * 12/1996 Le Gauyer ..... B21D 41/00 165/173
6,739,386 B2 * 5/2004 Lamich ..... F28F 9/0221 165/149
6,786,275 B2 9/2004 Dey et al.
8,037,930 B2 10/2011 Watanabe et al.
9,599,413 B2 3/2017 Augenstein et al.
9,816,767 B2 11/2017 Schwalm
10,697,568 B2 * 6/2020 Nakajima ..... B23K 1/008
2002/0134453 A1 * 9/2002 Chikuma ..... F28F 9/0258 138/155
2005/0061494 A1 * 3/2005 Tsuji ..... F28F 1/32 165/173
2007/0071920 A1 * 3/2007 Muto ..... F28D 1/05383 428/34.4
2007/0199686 A1 * 8/2007 Okinotani ..... F28F 19/00 165/152
2010/0319889 A1 * 12/2010 Ikeda ..... F28F 1/025 165/157
2016/0223272 A1 * 8/2016 Nakamura ..... F28F 1/025
2017/0248372 A1 8/2017 Erno et al.

FOREIGN PATENT DOCUMENTS

FR 3056734 A1 3/2018
JP 10137877 A * 5/1998 ..... F28D 1/0316
JP H10-137877 A 5/1998
JP 2011-43257 A 3/2011
JP 2016217654 A * 12/2016
WO WO-2015037687 A1 * 3/2015 ..... F28F 3/02

* cited by examiner

CAST PLATE HEAT EXCHANGER WITH TAPERED WALLS

CROSS-REFERENCE TO RELATED APPLICATION

This application claims priority to U.S. Provisional Application No. 62/666,184 filed on May 3, 2018.

BACKGROUND

A plate fin heat exchanger includes adjacent flow paths that transfer heat from a hot flow to a cooling flow. The flow paths are defined by a combination of plates and fins that are arranged to transfer heat from one flow to another flow. The plates and fins are created from sheet metal material brazed together to define the different flow paths. Thermal gradients present in the sheet material create stresses that can be very high in certain locations. The stresses are typically largest in one corner where the hot side flow first meets the coldest portion of the cooling flow. In an opposite corner where the coldest hot side flow meets the hottest cold side flow, the temperature difference is much less resulting in unbalanced stresses across the heat exchanger structure. Increasing temperatures and pressures can result in stresses on the structure that can exceed material and assembly capabilities.

Turbine engine manufactures utilize heat exchangers throughout the engine to cool and condition airflow for cooling and other operational needs. Improvements to turbine engines have enabled increases in operational temperatures and pressures. The increases in temperatures and pressures improve engine efficiency but also increase demands on all engine components including heat exchangers. Existing heat exchangers are a bottleneck in making system-wide efficiency improvements because they do not have adequate characteristics to withstand increased demands. Improved heat exchanger designs can require alternate construction techniques that can present challenges to the feasible practicality of implementation.

Turbine engine manufacturers continue to seek further improvements to engine performance including improvements to thermal, transfer and propulsive efficiencies.

SUMMARY

In a featured embodiment, a heat exchanger includes a plate including a plate portion having outer walls. A plurality of internal passages extend between end portions. A ratio between an outer wall cross-sectional thickness at one of the end portions and a cross-sectional wall thickness of the outer wall within the plate portion is greater than 2.5 and no more than 10. An inlet manifold is attached to the inlet end. An outlet manifold is attached to the outlet end.

In another embodiment according to the previous embodiment, the end portions includes a face surrounded by peripheral walls and the peripheral walls define the outer wall cross-sectional thickness at one of the end portions.

In another embodiment according to any of the previous embodiments, the plate portion includes a plate width between a leading edge and a trailing edge and an end width between outer surfaces of the peripheral walls in same direction as the plate width is greater than the plate width.

In another embodiment according to any of the previous embodiments, a tapered transition is between the plate portion and at least one of the end portions. The tapered transition includes an increasing wall thickness in a direction from the plate portion toward the at least one of the end portions.

In another embodiment according to any of the previous embodiments, the leading edge includes a contour that extends into the tapered transition.

In another embodiment according to any of the previous embodiments, a plate thickness is less than an end portion thickness.

In another embodiment according to any of the previous embodiments, the face includes a plurality of openings within a common plane and the peripheral wall extends outward from the common plane.

In another embodiment according to any of the previous embodiments, a tapered inlet is around each of the plurality of openings.

In another embodiment according to any of the previous embodiments, a joint is between an outer surface of each of the end portions and an inner surface of a corresponding one of the inlet manifold and the outlet manifold.

In another embodiment according to any of the previous embodiments, a wall thickness of the corresponding one of the inlet manifold and outlet manifold through a joint plane is less than a wall thickness of the corresponding one of the end portions.

In another embodiment according to any of the previous embodiments, the plate is a single unitary part including the plate portion and end portions.

In another featured embodiment, a heat exchanger includes a plate including a plate portion having outer walls, a plurality of internal passages extend between end portions and a tapered transition is between the plate portion and at least one of the end portion. The tapered transition includes an increasing wall thickness in a direction from the plate portion toward at least one of the end portions. An inlet manifold is attached to the inlet end. An outlet manifold is attached to the outlet end.

In another embodiment according to the previous embodiment, a ratio is between an outer wall cross-sectional thickness at one of the end portions and a cross-sectional wall thickness of the outer wall within the plate portion is greater than 2.5 and no more than 10.

In another embodiment according to any of the previous embodiments, the plate portion includes a plate width between a leading edge and a trailing edge and an end width between outer surfaces of at least one of the end portions. The plate width is less than the end width.

In another embodiment according to any of the previous embodiments, the leading edge includes a contour that extends into the tapered transition.

In another embodiment according to any of the previous embodiments, a plate thickness is less than an end portion thickness.

In another embodiment according to any of the previous embodiments, the end portions include a plurality of openings within a common plane and a peripheral wall extends about the plurality of openings.

In another embodiment according to any of the previous embodiments, a tapered inlet is around each of the plurality of openings.

In another embodiment according to any of the previous embodiments, a joint is between an outer surface of each of the end portions and an inner surface of a corresponding one of the inlet manifold and the outlet manifold. A wall thickness of the corresponding one of the inlet manifold and outlet manifold through the joint plane is less than a wall thickness of the corresponding one of the end portions.

In another embodiment according to any of the previous embodiments, the plate is a single unitary part including the plate portion and end portions.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
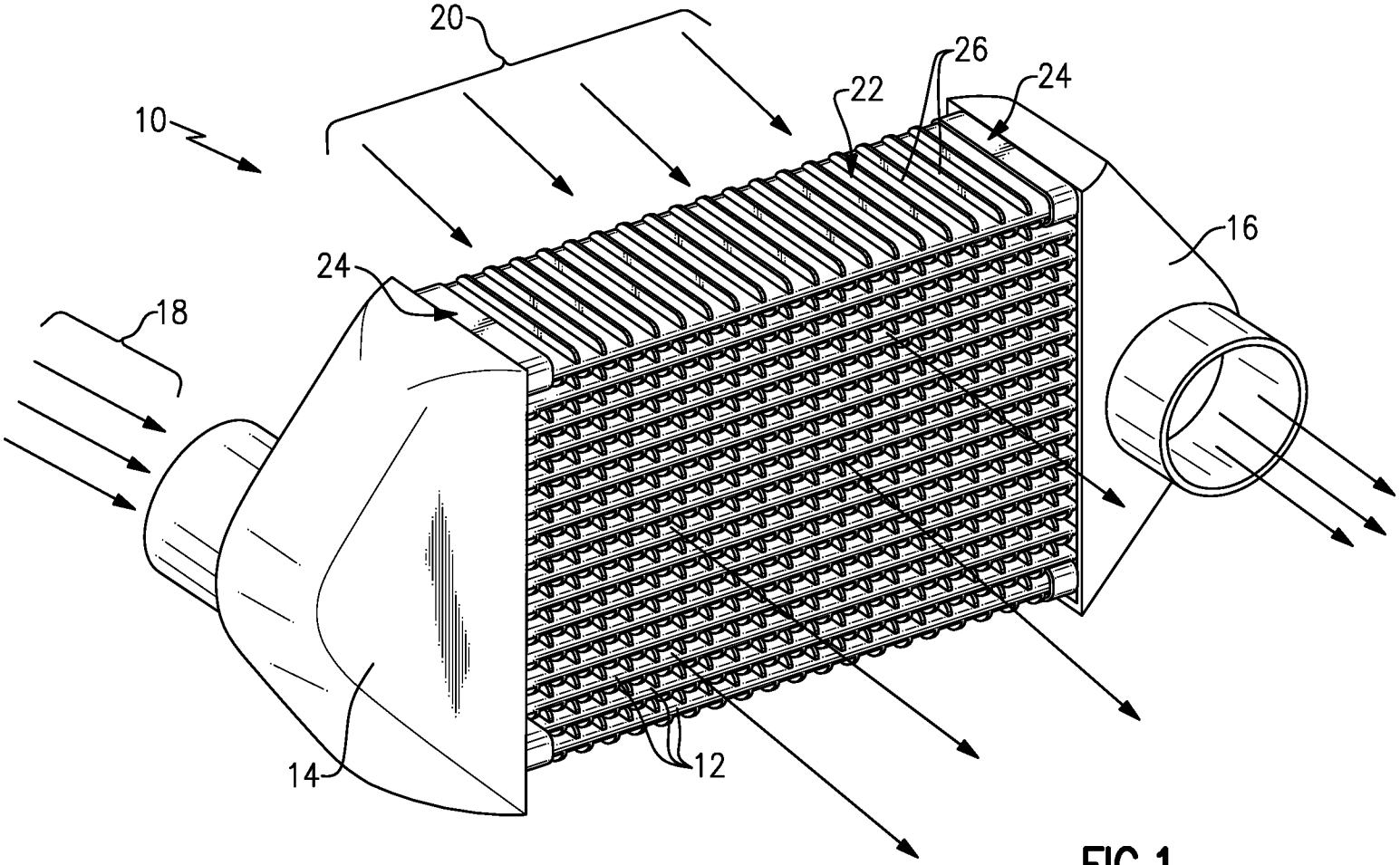
FIG. 1 is a perspective view of an example heat exchanger assembly.

Referring to FIG. 1 an example heat exchanger 10 includes a plurality of cast plates 12 disposed between an inlet manifold 14 and an outlet manifold 16. Each of the plates 12 include a plate portion 22 that define a plurality of passages that extend between end portions 24. A hot flow schematically shown at 18 is communicated through the plates 12 and exchanges thermal energy with the cooling airflow 20 that flows over outer surfaces of each of the plates 12.

The difference in temperatures between the hot flow 18 and the cold flow 20 can result in mechanical stresses being encountered at joint surfaces between the inlet and outlet manifolds 14, 16. The example plates 12 include end portions 24 with features that accommodate the differences in temperatures between the hot flow and the cold flow to moderate mechanical stresses and strains.

Figure 2:
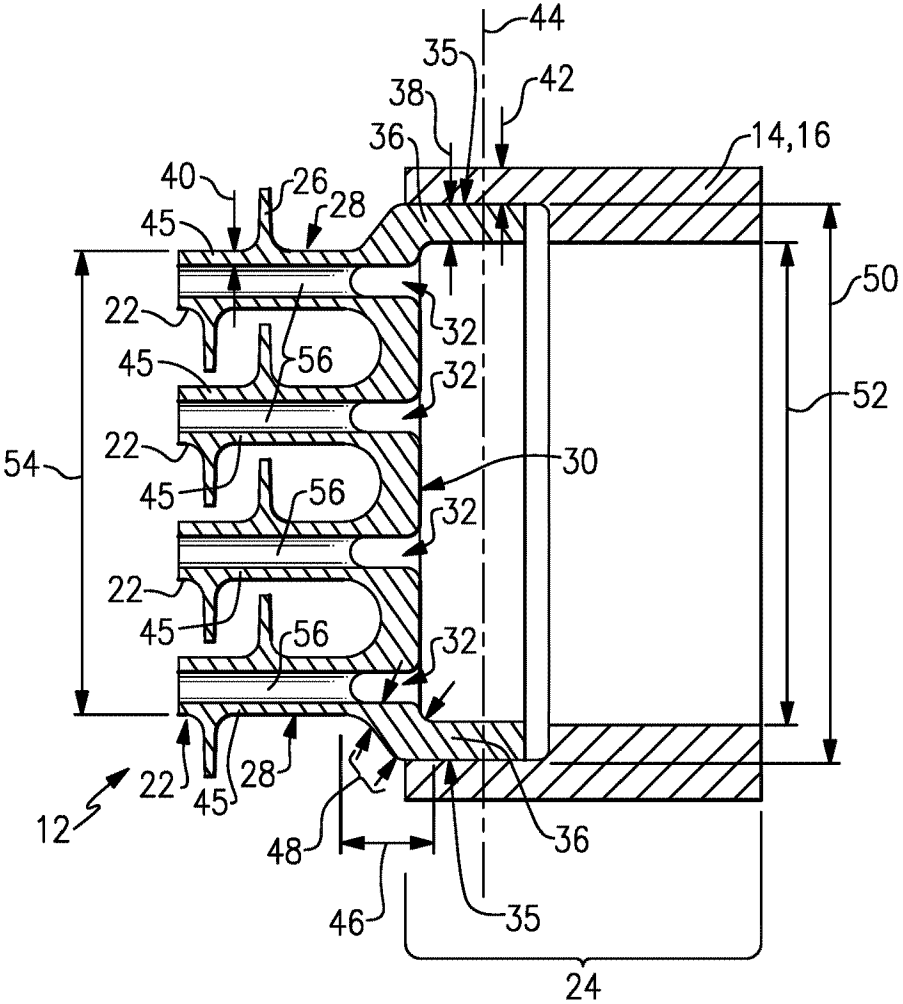
FIG. 2 is a cross-sectional view of a portion of the example heat exchanger.

Referring to FIG. 2 with continued reference to FIG. 1 an example plate 12 is schematically shown and includes a plurality of plate portions 22 that are in communication with a common end portion 24. A plurality of fins 26 extend from outer surfaces 28 of each plate portion 22. A plurality of passages 56 extend through the plate portions 22 between the end portions 24. In this disclosed example, the plate 12 includes several integral plate portions 22 that extend and are in communication with the common end portion 24.

There is a large gradient in both the hot flow and cold flow directions in the plates 12 as well as a thermal gradient formed between the plates 12 and the manifolds 14, 16. The thin walled plates 12 are, at times, subject to cooling flow and therefore respond at thermal growth rates different than that of the thick walled manifolds 14, 16. The manifolds 14, 16 encounter a similar hot flow but a relatively stagnant cold flow compared to the plates 12. Accordingly, the plates 12 include tapering walls to reduce differences in thermal expansions and contractions and to provide a more gradual stiffness transition between the manifolds 14, 16 and the plates 12.

The end portion 24 includes a width 50 that is greater than a width 54 of the plate portions 22. The expanded outer width 50 of the end portion 24 is provided by a wall thickness 38. The end portion 24 includes a peripheral wall 36 that surrounds an end face 30. The end face 30 is a common surface that includes openings 32 for passages 56 within each of the plate portions 22. The plate portions 22 include an outer wall 45 that includes a wall thickness 40. Thermal energy is communicated through the walls 45 that are subsequently cooled by the cooling airflow 20.

The example end portion 24 includes a configuration reduces stress within a joint between the plate 12 and each of the manifolds 14, 16. In contrast, the outer walls 45 include a thickness 40 that is relatively thin to provide a high level of thermal transfer. Although the plates 12 experience large thermal gradients, the plates 12 are exposed to a cooling airflow and therefore remain within desired design ranges.

The inlet manifold and outlet manifold 14, 16 have relatively thick walls and are not exposed to a constant cooling airflow. Accordingly, the manifolds 14, 16 can become much hotter than the plate portions 22 and therefore mare expand and contract at rates different than the plates 12. A thermal difference between the temperature of the plate portion 22 and each of the manifolds 14, 16 generate a large thermal gradient that can generate increased mechanical stresses along a joint plane schematically shown at 44.

The disclosed end portion 24 includes an end peripheral wall 36 with a thickness 38. The thickness 38 is greater than the thickness 40 within the plate portions 22. The thicker peripheral wall 36 provides a more uniform transition from the thinner walls of the plate portions 22 to the thicker walls of the manifolds 14, 16. A transition region 46 is disposed between the walls 45 of the plate portions 22 and the walls 36 within the end portions 24. The transition region 46 includes an increasing wall thickness between the thinner walls 40 in the plate portions 22 and the thicker walls 36 of the end portions 24. The transition region 46 and end portions 24 provides a more uniform thermal gradient between the plates 12 and each of the manifolds 14,16 to reduce mechanical stresses during operation.

Figure 3:
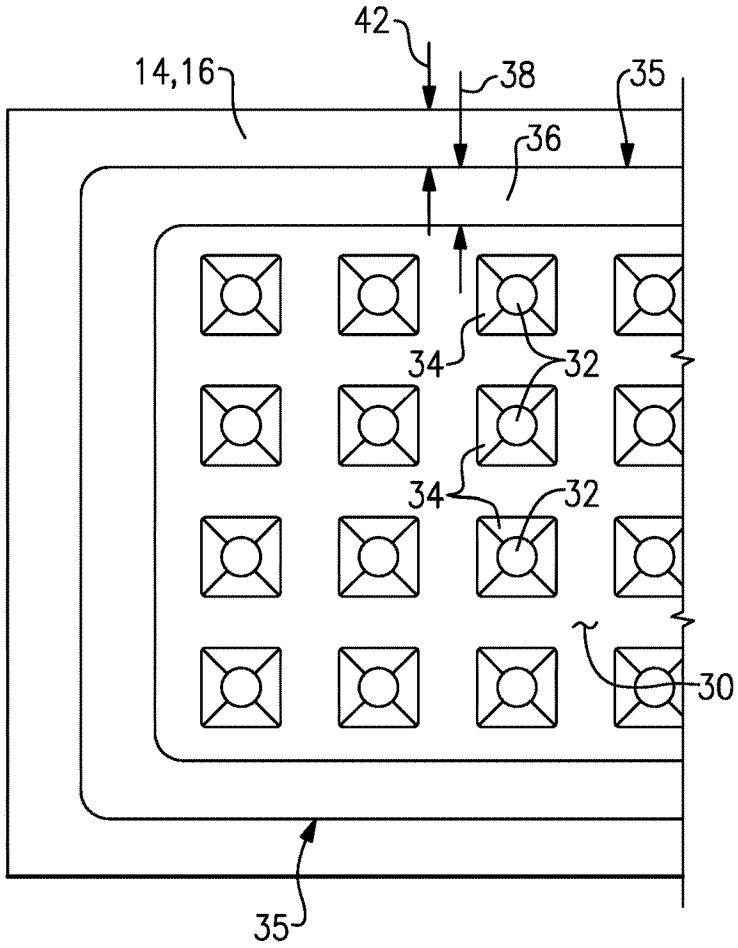
FIG. 3 is a partial end view of the example heat exchanger.

Referring to FIG. 3 with continued reference to FIG. 2 the peripheral wall 36 includes the wall thickness 38. The wall thickness 38 is greater than the wall thickness 40 within the plate portions 22 by a factor that is predetermined to provide a thermal gradient between the manifolds 14, 16 and the plate 12 that does not generate mechanical stresses outside of predefined limits. In one disclosed embodiment, the cross-sectional wall thickness 38 within the end portions 24 is between 2.5 and 10.0 times greater than the wall thickness 40 within the plate portions 22. In another disclosed embodiment, the cross-sectional wall thickness 38 within the end portions 24 is between 5.0 and 10 times greater than the wall thickness 40 within the plate portions 22.

The increased cross-sectional thickness of the peripheral wall 36 is provided through the transition region schematically shown at 46. A wall thickness 48 within the transition region 46 increases in a direction towards the end portion 24. The increasing thickness reduces the differences in temperature between the mating parts along the joint interface 44 to reduce mechanical stresses that may be encountered within that joint.

The end face 30 includes the openings 32 that include a taper 34 that encourages flow into each of the passages 56. The taper 34 further distributes thermal energy by reducing flow disruptions at the inlets to the passages 56.

The peripheral walls 36 include outer surfaces 35 that engage with inner surfaces of the manifold 14, 16. The peripheral walls include an outer width 50 and an inner width 52. The outer width 50 is greater than an outer width 54 within the plate 12. In this example embodiment, the end portion 24 expands outwardly both vertically and horizontally from the height and width of the plate portions 22. The expanded width 50 of the end portion 24 is provided by the increased wall thickness 48 within the transition region 46 and also by an increase in the inner width 52 as compared to the width 54 of the plate 12. Additionally, the manifolds 14, 16 includes a wall thickness 42 at the joint interface 44 that is less than the wall thickness 38 in the end portions 24.

Figure 4:
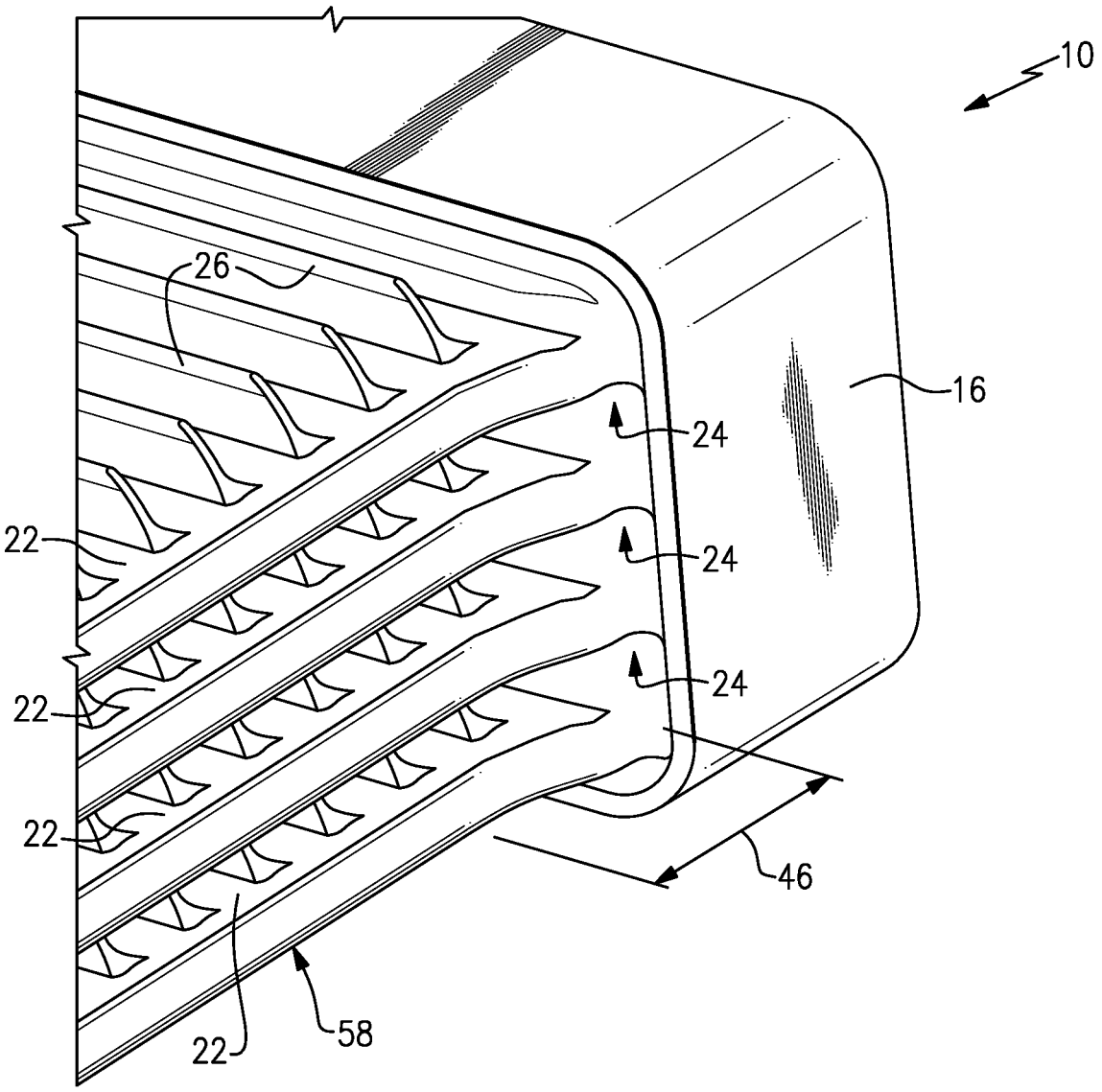
FIG. 4 is a perspective view of an interface between an intake manifold and plate.
Figure 6:
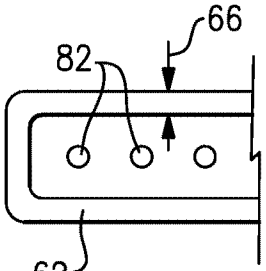
FIG. 6 is an end view of the example plate.
Figure 8:
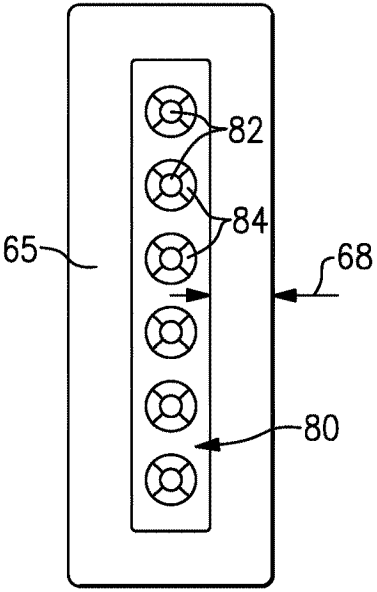
FIG. 8 is another end view of the example plate.
Figure 5:
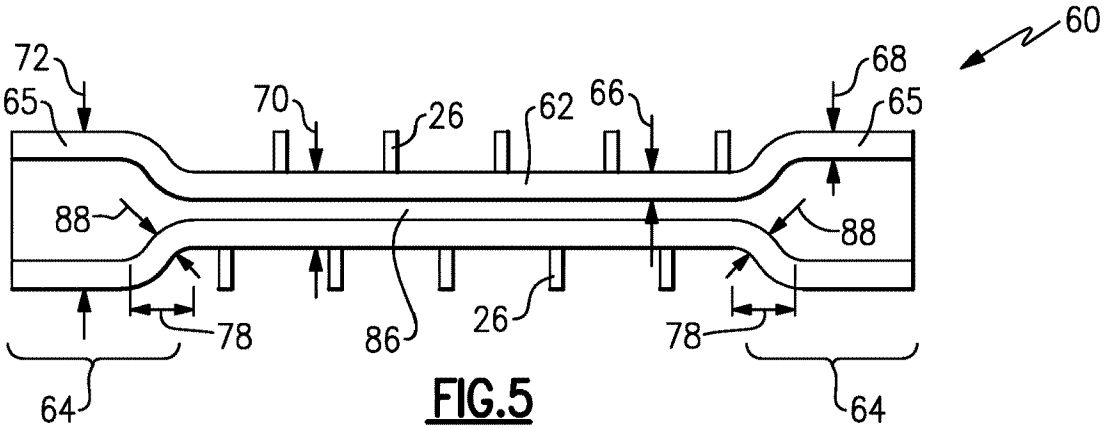
FIG. 5 is a cross-sectional view of an example plate.
Figure 7:
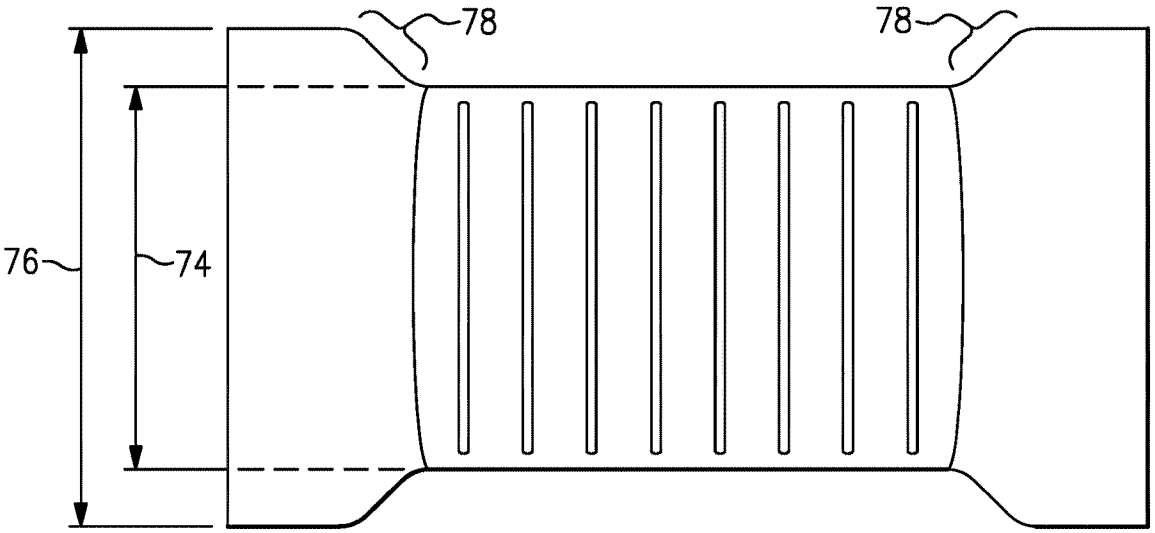
FIG. 7 is a top view of the example plate.

Referring to FIG. 4 with continued reference to FIGS. 2 and 3 a perspective view of an example interface between the manifold 16 and end portion 24 of the plate 12 is schematically shown and shows a leading edge 58 of each of the plate portions 22. A leading edge 58 includes a rounded shape that is included through the transition region 46 and into the end portions 24. The smooth leading edge 58 reduces or eliminates sharp corners that can focus thermal stresses and mechanical strains. Moreover, the smooth leading edge 58 improves airflow characteristics over the outer surface of the plate 12.

Referring to FIGS. 5, 6, 7 and 8 another plate 60 is schematically shown and includes only a single row of passages 56. The plate 60 includes outer surfaces with a plurality of fins 26. End portion 64 are disposed on either side of plate portion 62 and include a peripheral wall 65 having a wall thickness 68 that is greater than a wall thickness 70 within the plate portion 62. In one disclosed embodiment, the wall thickness 68 within the end portions 64 is between 2.5 and 10 times greater than the wall thickness 66 within the plate portion 62. In another disclosed embodiment, the cross-sectional wall thickness 68 within the end portions 64 is between 5.0 and 10 times greater than the wall thickness 66 within the plate portion 62.

The end portions 64 includes a total thickness 72 and outer width 76. The plate portion 62 includes a total thickness 70 and an outer width 74. The total thickness 72 of the end portions 64 is greater than the thickness 70 of the plate portions 62. The outer width 76 in the end portions 64 is greater than the width 74 of the plate portion 62. Accordingly, the end portion 62 expands vertically and horizontally from the plate portion 62 to provide an interface with the manifolds 14, 16 that reduces differences in temperature therebetween.

The peripheral wall 65 surrounds an end face 80 with a plurality of openings 82 that communicate with passages 86 through the plate portion 66. The openings 82 are surrounded by a taper 84 that aids inflow into the passages 86.

A transition region 78 includes an increasing wall thickness 88 as compared to the wall thicknesses 66 within the plate portion 62. The thinner wall thickness 66 with the plate portion 62 provides improved thermal transfer. The thicker wall sections 68 within the end portions 64 are provided to enable and generate a more uniform thermal gradient that reduces differences within a joint with manifolds 14, 16.

The disclosed example heat exchanger plates 12, 60 are one piece cast structures that include integral inner and outer structures. The plates 12, 60 are formed from materials determined to provide defined mechanical and thermal characteristics that meet application specific requirements.

The disclosed example heat exchanger plates 12, 60 include varying thicknesses between plate and end portions that reduce thermal gradients and thereby mechanical stresses within joint regions.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A heat exchanger comprising:

a plate including a plate portion, an inlet end portion and an outlet end portion, the plate portion having outer walls and a plurality of internal passages extending between the inlet end portion and the outlet end portion, wherein a ratio between an outer wall cross-sectional thickness at one of the inlet end portion or the outlet end portion and a cross-sectional wall thickness of the outer wall within the plate portion is greater than 2.5 and no more than 10, wherein the plate portion includes a plate width between a leading edge and a trailing edge, an end width between outer surfaces of the peripheral walls in the same direction as the plate width with the end width greater than the plate width and a tapered transition between the plate width and the end width at one of the inlet end portion or the outlet end portion, wherein the tapered transition includes an increasing wall thickness in a direction from the plate portion toward the at least one of the inlet end portion or the outlet end portion;

an inlet manifold attached to the inlet end portion; and an outlet manifold attached to the outlet end portion, wherein each of the inlet end portion and the outlet end portion include a face surrounded by peripheral walls and the peripheral walls define the outer wall cross-sectional thickness.

2. The heat exchanger as recited in claim 1, wherein the leading edge includes a contour that extends into the tapered transition.

3. The heat exchanger as recited in claim 2, wherein a thickness of the plate portion is less than a thickness of the inlet end portion or the outlet end portion.

4. The heat exchanger as recited in claim 2, wherein the face includes a plurality of openings within a common plane and the peripheral wall extends outward from the common plane.

5. The heat exchanger as recited in claim 4, including a tapered inlet around each of the plurality of openings.

6. The heat exchanger as recited in claim 1, including a joint between an outer surface of each of the inlet end portion and the outlet end portion and an inner surface of a corresponding one of the inlet manifold and the outlet manifold.

7. The heat exchanger as recited in claim 6, wherein a wall thickness of the corresponding one of the inlet manifold and outlet manifold through a joint plane is less than a wall thickness of the corresponding one of the inlet end portion and the outlet end portion.

8. The heat exchanger as recited in claim 1, wherein the plate is a single unitary part including the plate portion, the inlet end portion and the outlet end portion.

9. A heat exchanger comprising:

a plate including a plate portion, an inlet end portion and an outlet end portion, the plate portion having outer walls, a plurality of internal passages extending between the inlet portion and the outlet end portion and a tapered transition between the plate portion and at least one of the inlet end portion or the outlet end portion, wherein the tapered transition includes an increasing wall thickness in a direction from the plate portion toward the at least one of the inlet end portion or the outlet end portion;

an inlet manifold attached to the inlet end portion; and an outlet manifold attached to the outlet end portion.

10. The heat exchanger as recited in claim 9, wherein a ratio between an outer wall cross-sectional thickness at one of the inlet end portion or the outlet end portion and a cross-sectional wall thickness of the outer wall within the plate portion is greater than 2.5 and no more than 10.

11. The heat exchanger as recited in claim 9, wherein the plate portion includes a plate width between a leading edge and a trailing edge and an end width between outer surfaces of at least one of the inlet end portion or the outlet end portion, wherein the plate width is less than the end width.

12. The heat exchanger as recited in claim 11, wherein the leading edge includes a contour that extends into the tapered transition.

13. The heat exchanger as recited in claim 12, wherein a thickness of the plate portion is less than a thickness of either the inlet end portion or the outlet end portion.

14. The heat exchanger as recited in claim 9, wherein the inlet end portion and the outlet end portion each include a plurality of openings within a common plane and a peripheral wall extending about the plurality of openings.

15. The heat exchanger as recited in claim 14, including a tapered inlet around each of the plurality of openings.

16. The heat exchanger as recited in claim 14, including a joint between an outer surface of each of the inlet end portion and the outlet end portion and an inner surface of a corresponding one of the inlet manifold and the outlet manifold, wherein a wall thickness of the corresponding one of the inlet manifold and outlet manifold through the joint plane is less than a wall thickness of the corresponding one of the inlet end portion and the outlet end portion.

17. The heat exchanger as recited in claim 9, wherein the plate is a single unitary part including the plate portion and end portions.

* * * * *